US012312047B2

(12) United States Patent
Bolline et al.

(10) Patent No.: US 12,312,047 B2
(45) Date of Patent: May 27, 2025

(54) POWERED RETRACTABLE LADDER

(71) Applicant: Nautical Structures Industries, Inc., Largo, FL (US)

(72) Inventors: Robert Bolline, Largo, FL (US); Scott Danforth, Largo, FL (US); Matthew Freeburg, Largo, FL (US); Scott Milford, Largo, FL (US); Art Sciarrotta, Largo, FL (US); Steven Gioiosa, Clearwater, FL (US); Mike Krawczyk, Clearwater, FL (US); Keith Stephens, Clearwater, FL (US); Nat McCormick, Cleartwater, FL (US); Benedict Capuco, Arlington, VA (US)

(73) Assignee: Nautical Structures Industries, Inc., Largo, FL (US)

( * ) Notice: Subject to any disclaimer, the term of this patent is extended or adjusted under 35 U.S.C. 154(b) by 629 days.

(21) Appl. No.: 17/662,110

(22) Filed: May 5, 2022

(65) Prior Publication Data

US 2022/0363347 A1 Nov. 17, 2022

Related U.S. Application Data

(60) Provisional application No. 63/186,921, filed on May 11, 2021.

(51) Int. Cl.
*B63B 27/14* (2006.01)

(52) U.S. Cl.
CPC ..... *B63B 27/146* (2013.01)

(58) Field of Classification Search
CPC . B63B 27/146; E06C 1/56; E06C 7/02; E06C 7/08; E06C 7/182; E06C 9/14
USPC ..... 114/362; 182/40, 42, 62.5
See application file for complete search history.

(56) References Cited

U.S. PATENT DOCUMENTS

| | | | | |
|---|---|---|---|---|
| 277,222 A | 5/1883 | Bush | | |
| 487,569 A | 12/1892 | Howell | | |
| 2,905,264 A | 9/1959 | Dennis | | |
| 4,193,476 A * | 3/1980 | Emmons | E06C 1/36 | 182/189 |
| 4,613,013 A * | 9/1986 | Watling | E06C 1/52 | 182/20 |
| 4,884,659 A * | 12/1989 | Chao | E06C 1/52 | 182/164 |
| 9,500,027 B2 * | 11/2016 | Walter | E06C 7/50 | |

FOREIGN PATENT DOCUMENTS

| | | |
|---|---|---|
| CN | 200 955 349 Y | 10/2007 |
| JP | H06 71395 U | 10/1994 |
| KR | 10-2013-0050673 | 5/2013 |

* cited by examiner

*Primary Examiner* — Daniel V Venne
(74) *Attorney, Agent, or Firm* — Larson & Larson; Frank Liebenow

(57) ABSTRACT

The powered retractable ship ladder replaces the current technology of manually-lowered ship ladders. The powered ladder includes powered extension and retraction, with the added capability of being able to lift a user during ladder retraction. The ladder is formed from a collection of links. The links only permit the ladder to bend in one direction, thus keeping the extended ladder against the side of the ship, rather than swinging toward and away from the ship.

15 Claims, 12 Drawing Sheets

POWERED RETRACTABLE LADDER

RELATED APPLICATIONS

This application claims priority to provisional application No. 63/186,921, filed May 11, 2021, titled Powered retractable ladder.

FIELD

This invention relates to the field of ship ladders and more particularly to a powered retractable ladder.

BACKGROUND

Ships must be able to take on and let off personnel, even while at sea.

Ideally this is performed by helicopter. But in heavy seas, or for ships without helipads, this is an impractical solution.

A rope ladder, or pilot ladder, is the most common alternative to a helipad. While simple, its flexible nature creates hazards when climbing the side of a rolling ship.

Additionally, to be lowered over the side of a ship a rope ladder requires the assistance of a human operator.

What is needed is a powered ladder that allows a user to safely climb the side of a ship while the ship is at sea.

SUMMARY

The powered retractable ship ladder replaces the current technology of manually-lowered ship ladders.

The powered ladder is preferably fully hydraulic, including powered extension and retraction. Hydraulic systems are more robust than electronic and electrical systems, which is critical for a ladder mounted on the exterior of an ocean-going vessel.

The use of hydraulics to power the ladder has the benefit of making sufficient torque available to lift the ladder with the additional load of a user. As a result, it is possible to retract the ladder while one or more individuals hold onto the steps, allowing for removal of personnel from a boat at the base of the ladder.

In the described preferred embodiment, a single hydraulic cylinder actuates the boom, causing both the boom and the ladder to move between a storage, or stowed, position and an active position. A main cog-drive motor and a reel motor act together to raise and lower the chain that forms the ladder.

The main motor, or first hydraulic motor, rotates a ladder interface gear, or cog, that meshes with the chain that forms the ladder. The main motor acts as a brake when the ladder is being raised, helping to maintain tension between the ladder interface gear and the reel.

The reel motor, or second hydraulic motor, resists unspooling as ladder descends, preventing free-spinning of spool caused by the weight of the ladder. The reel motor also helps to pull up the ladder during retraction, preventing rungs from bunching-up between the reel and the ladder interface gear.

The ladder is formed from a collection of links that create a chain, specifically a pair of parallel chains. The links are preferably formed from a stiff material that resists bending. For example, metal, stiff plastics, or stiff rubbers. As discussed below, some or all of the links can be formed from flexible materials.

Prior art ladders are permitted to swing both toward and away from the ship. The result is that prior art ladders can act like a pendulum, swinging away from the ship and then gathering speed as they swing back toward the ship. When this occurs, any individual climbing the ladder is forced into the side of the ship. This collision can cause serious injury and death. The result has been numerous fatalities.

By preventing the ladder from swinging away from the side of the ship the ladder is unable to create any momentum. instead, the ladder is only able to swing between its neutral position and a position directly against the ship. The distance between the neutral position and the side of the ship is small, thus limiting the force of any resulting collision.

While the links of the ladder are preferably formed from stiff materials, the ladder is able to roll up for storage. This is accomplished by only permitting the ladder to bend in one direction—toward the side of the ship. The result is that the ladder readily folds, or rolls, for storage on a reel.

This limitation of rotation is accomplished by the interaction of a pin and a slot, the pin able to slide within the slot to allow bending of the ladder in one direction.

In one embodiment, the lower three sections of the ladder include vertical links constructed from a flexible material, rather than a stiff material such as metal. For example, a rubber material similar to that used for conveyor belts. Even with flexible vertical links, the steps, or treads, are constructed from a stiff material, such as a plastic.

The use of flexible material allows the ladder to partially collapse in a vertical direction—along its length—when a vertical load is applied. This is helpful during use when the boat beneath the base of the ladder may rise due to waves. Allowing the ladder to flex avoids damage to the boat.

In an alternative embodiment, the flexible material is used for additional ladder sections. For example, the lower eight sections. By having additional flexible sections, the ladder becomes more resilient to large vertical loads that may be caused by, for example, larger boats.

The powered retractable ship ladder surrounds a standards-compliant rope ladder. Rope ladder rung spacing and rope spacing are common across the industry, thus the use of an internal rope ladder ensures that the user is familiar with the position of the ladder parts.

BRIEF DESCRIPTION OF THE DRAWINGS

The invention can be best understood by those having ordinary skill in the art by reference to the following detailed description when considered in conjunction with the accompanying drawings in which.

DETAILED DESCRIPTION

Figure 1:
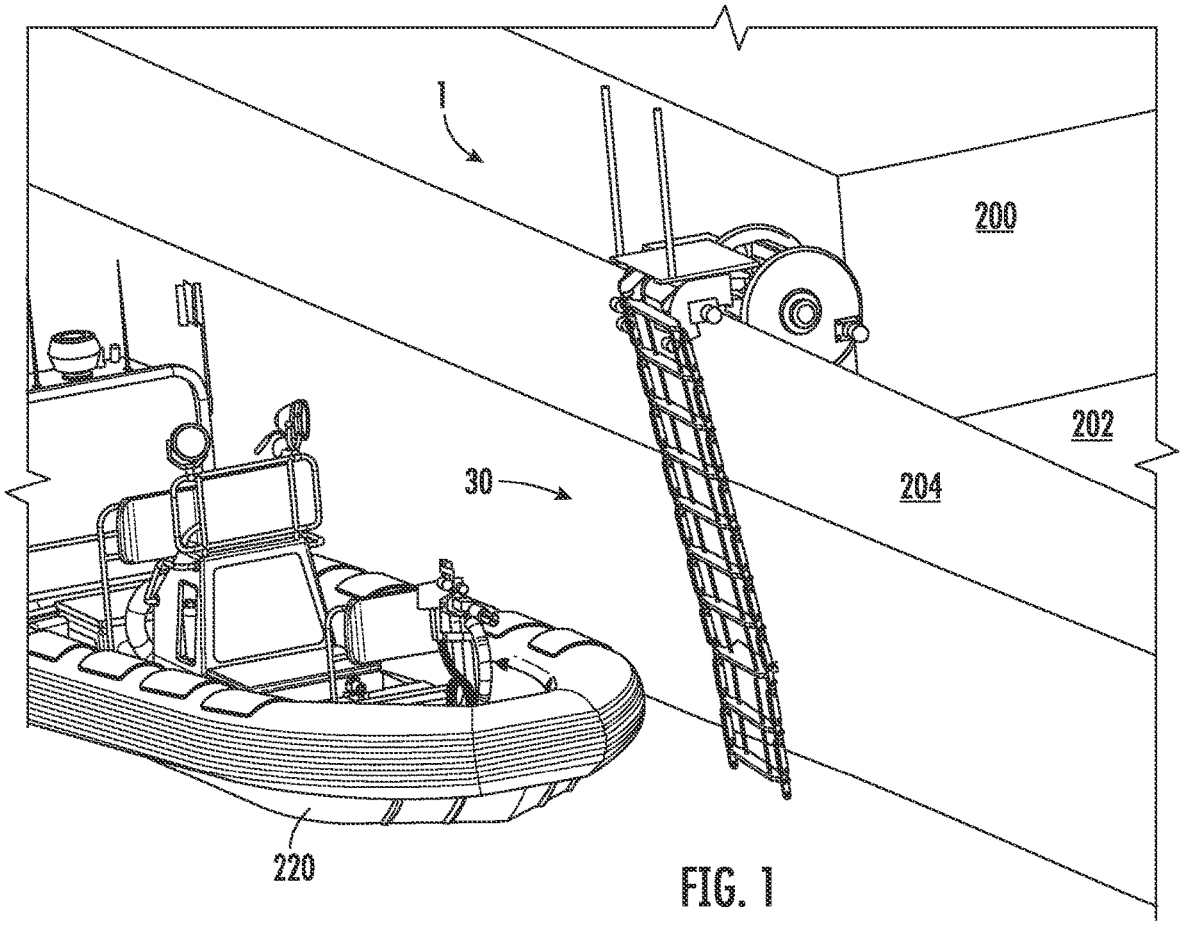
FIG. 1 illustrates a first view of the powered retractable ladder in an extended position.

Reference will now be made in detail to the presently preferred embodiments of the invention, examples of which are illustrated in the accompanying drawings. Throughout the following detailed description, the same reference numerals refer to the same elements in all figures.

Referring to FIG. 1, a first view of the of the powered retractable ladder in an extended position is shown.

The powered retractable ladder 1 is shown sitting above the deck 202 of the ship 200, the ladder 30 extended over the bulwark 204.

The ladder 30 extends down to the waterline 210, where a boat 220 can reach it.

Figure 2A:
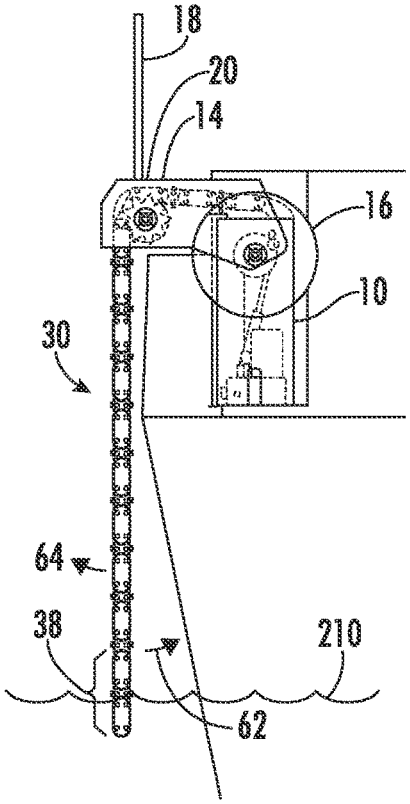
FIG. 2A illustrates a first side view of the powered retractable ladder in an extended position.
Figure 2B:
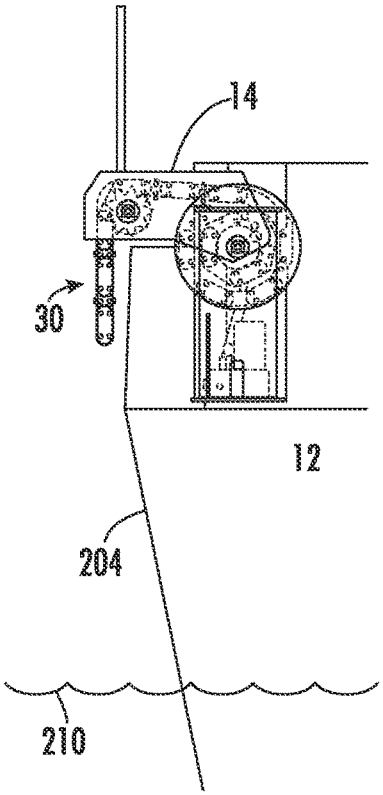
FIG. 2B illustrates a second side view of the powered retractable ladder in a retracted position.
Figure 2C:
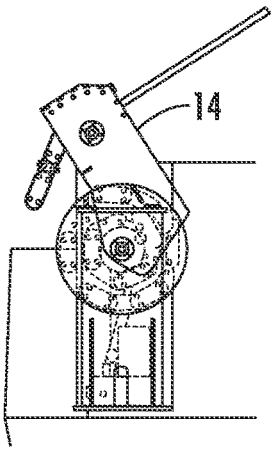
FIG. 2C illustrates a third side view of the powered retractable ladder in a stored position.

Referring to FIGS. 2A-2C, side views of the powered retractable ladder in an extended position, a retracted position, and a stored position are shown.

The powered retractable ladder 1 includes a frame 10, base 12, and rotating boom 14. The reel 16 is affixed to the frame 10.

A stanchion 18 extends above the platform 20, on which the user stands before or after climbing the ladder 30.

The boom 14 rotates from a deployed position, left, to a stowed position, right.

Optional flexible links 38 limit damage to a boat 220 (see FIG. 1) that may otherwise be damaged if it rose up under the ladder 30.

The ladder 30 is able to bend in the direction of permitted bending 62, toward the bulwark 204, but not in the direction of prohibited bending 64. Limiting this bending prevents the ladder 30 from becoming a pendulum, swinging the user away from, and then toward, the bulwark 204.

Figure 3:
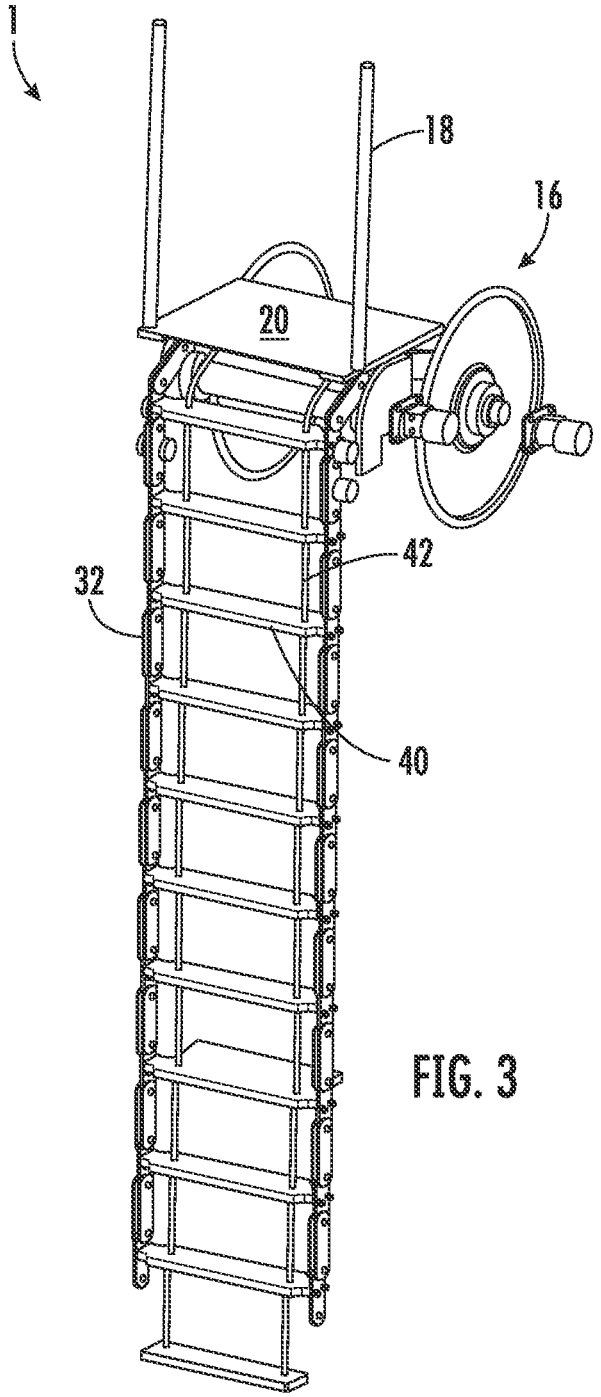
FIG. 3 illustrates an isometric view of the powered retractable ladder.

Referring to FIG. 3, an isometric view of the powered retractable ladder is shown.

The powered retractable ladder 1 is again shown with reel 16, and stanchion 18 on top of platform 20.

The ladder 30 extends downward, formed from chain 32 supporting steps 40, surrounding rope 42.

Figure 4:
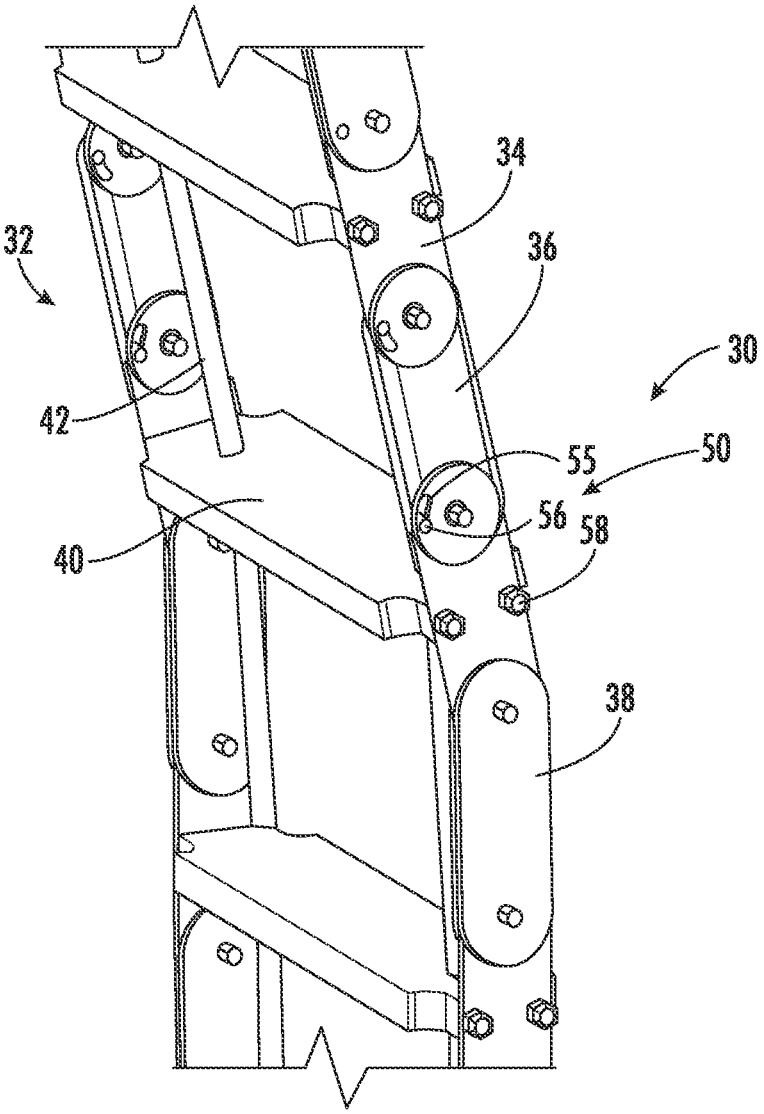
FIG. 4 illustrates a close-up view of the links of the powered retractable ladder.

Referring to FIG. 4, a close-up view of the links of the powered retractable ladder is shown.

The ladder 30 is formed from a chain 32, the chain 32 formed from inner links 34 and outer links 36.

The inner links 34 and outer links 36 meet at hinges 50. Rotation of the links 34/36 with respect to each other is limited by the slot pins 56 within slots 55.

Steps 40 are placed across the ladder 30, with rope guides 44 (see FIG. 5) surrounding the rope 42. The steps 40 are held in place by fasteners 58.

The lower end of the ladder 30 is optionally terminated with flexible links 38.

The flexible links 38 are optionally permitted to bend both toward and away from the ship, further limiting the ability of the ladder 30 to damage a ship caught beneath.

Figure 5:
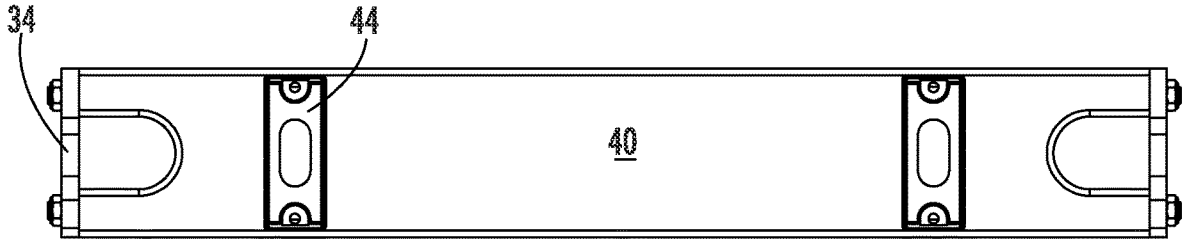
FIG. 5 illustrates a first detail view of a ladder step with inner and outer links of the powered retractable ladder.
Figure 6:
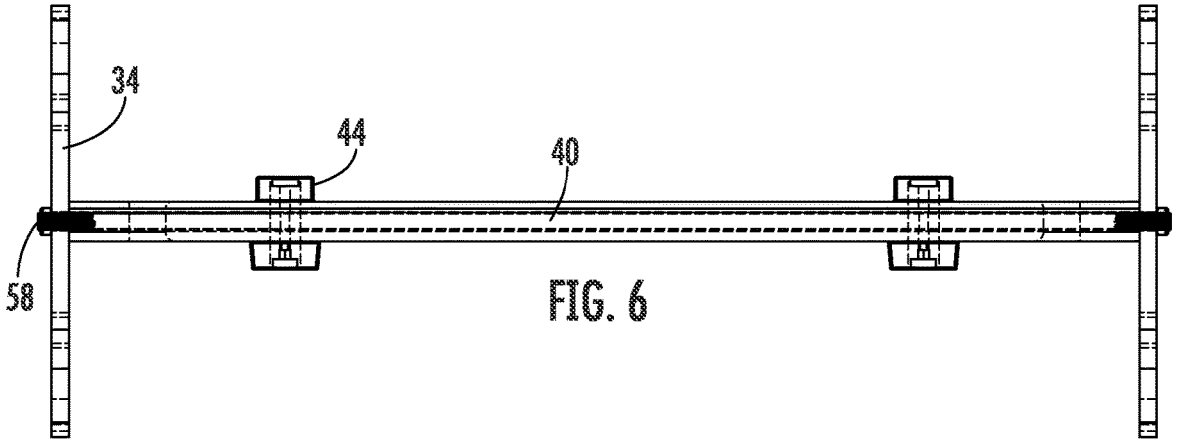
FIG. 6 illustrates a second detail view of a ladder step with inner and outer links of the powered retractable ladder.
Figure 7:
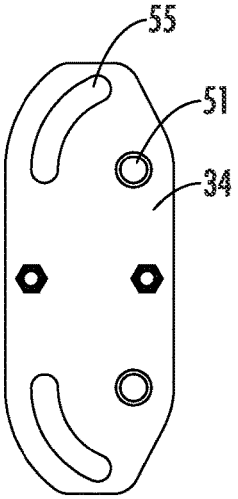
FIG. 7 illustrates a third detail view of a ladder step with inner and outer links of the powered retractable ladder.

Referring to FIGS. 5-7, views of a ladder step with inner and outer links of the powered retractable ladder are shown.

Each step 40 includes a rope guide 44. The steps 40 affix to inner links 34 via fasteners 58.

The inner links 34 include slots 55, the length and placement of which control the maximum rotation of each inner link 34 with respect to each outer link 36.

Figure 12:
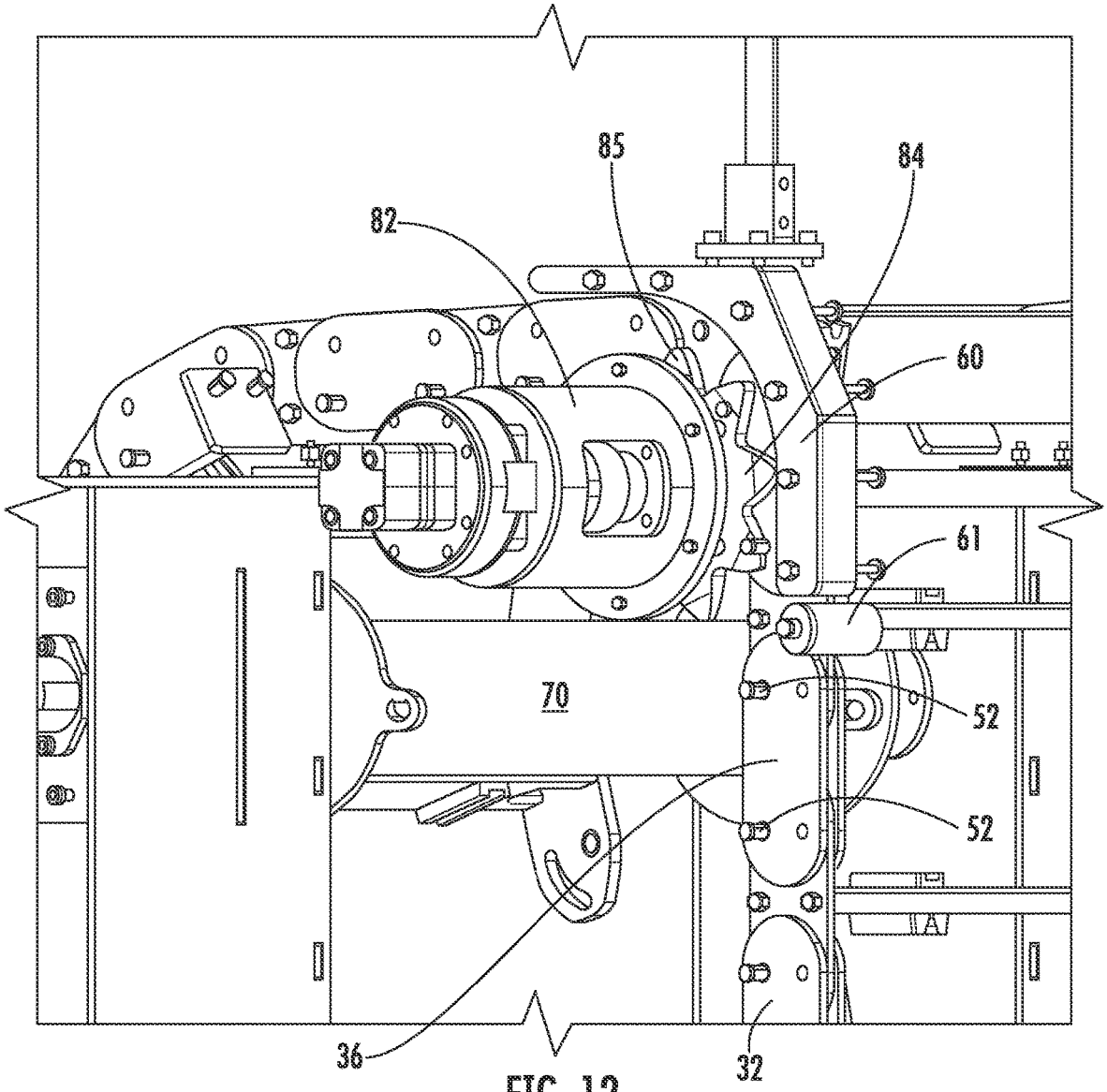
FIG. 12 illustrates a detail view of the mechanisms that help to extend and guide the ladder of the powered retractable ladder.

The hinge hole 51 holds the hinge pin 52 (see FIG. 12).

Figure 8:
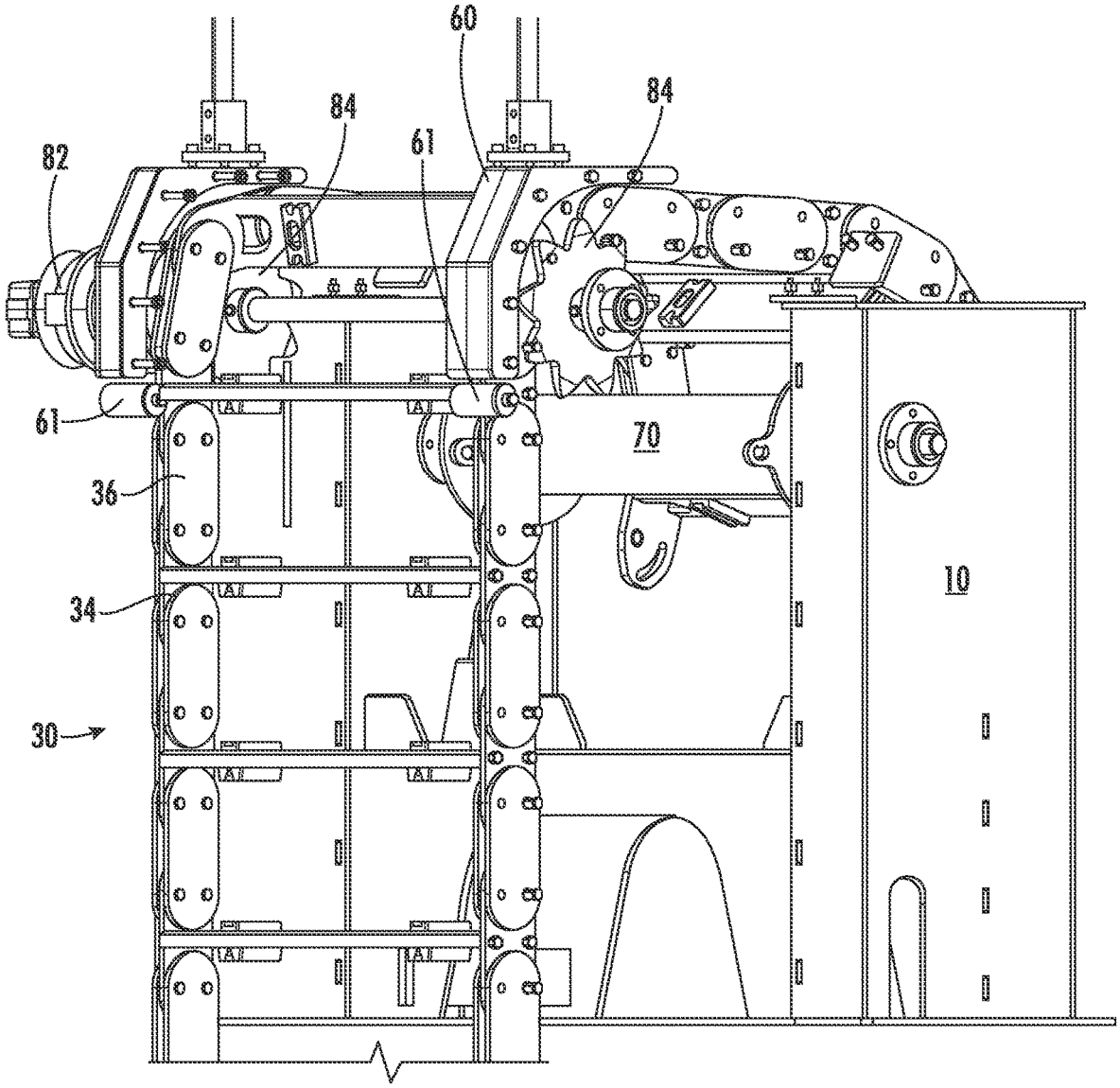
FIG. 8 illustrates a view of the main motor mechanism of the powered retractable ladder.
Figure 9:
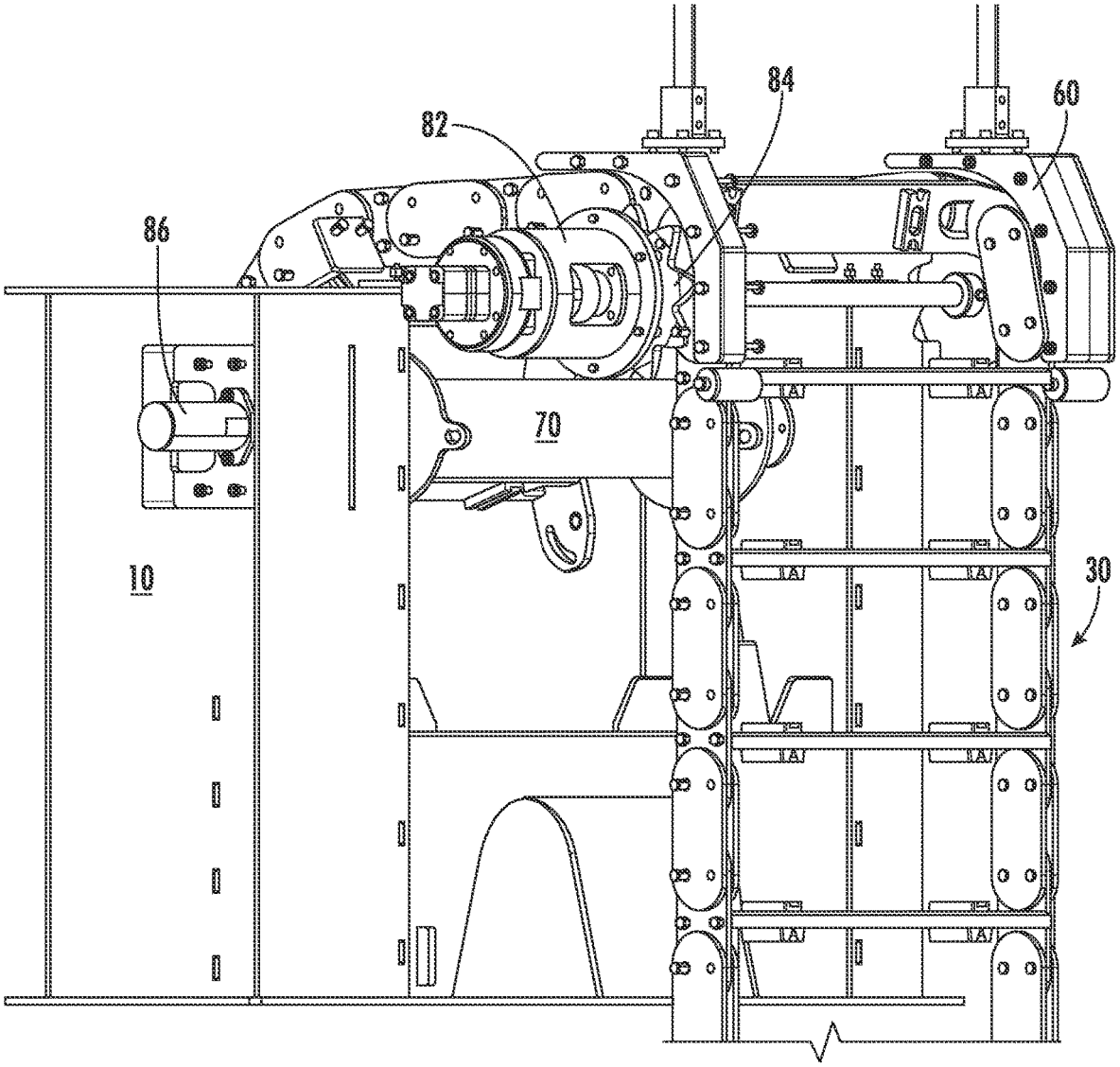
FIG. 9 illustrates a second view of the main motor mechanism of the powered retractable ladder.

Referring to FIGS. 8 and 9, two views of the main motor mechanism of the powered retractable ladder are shown.

The cog drive motor 82 is shown mechanically connected to the cog drive sprocket 84, which interfaces with the ladder 30 to cause upward and downward motion. The ladder 30 wraps around the reel core 70 as it is raised. The reel core 70 is supported by frame 10. The reel drive motor 86 controls rotation of the reel core 70.

Outward deflection of the ladder 30 is limited by a fixed ladder guides 60 and guide rollers 61, one set for each chain 32.

Again shown is the chain 32 formed from inner links 34 and outer links 36.

Figure 10:
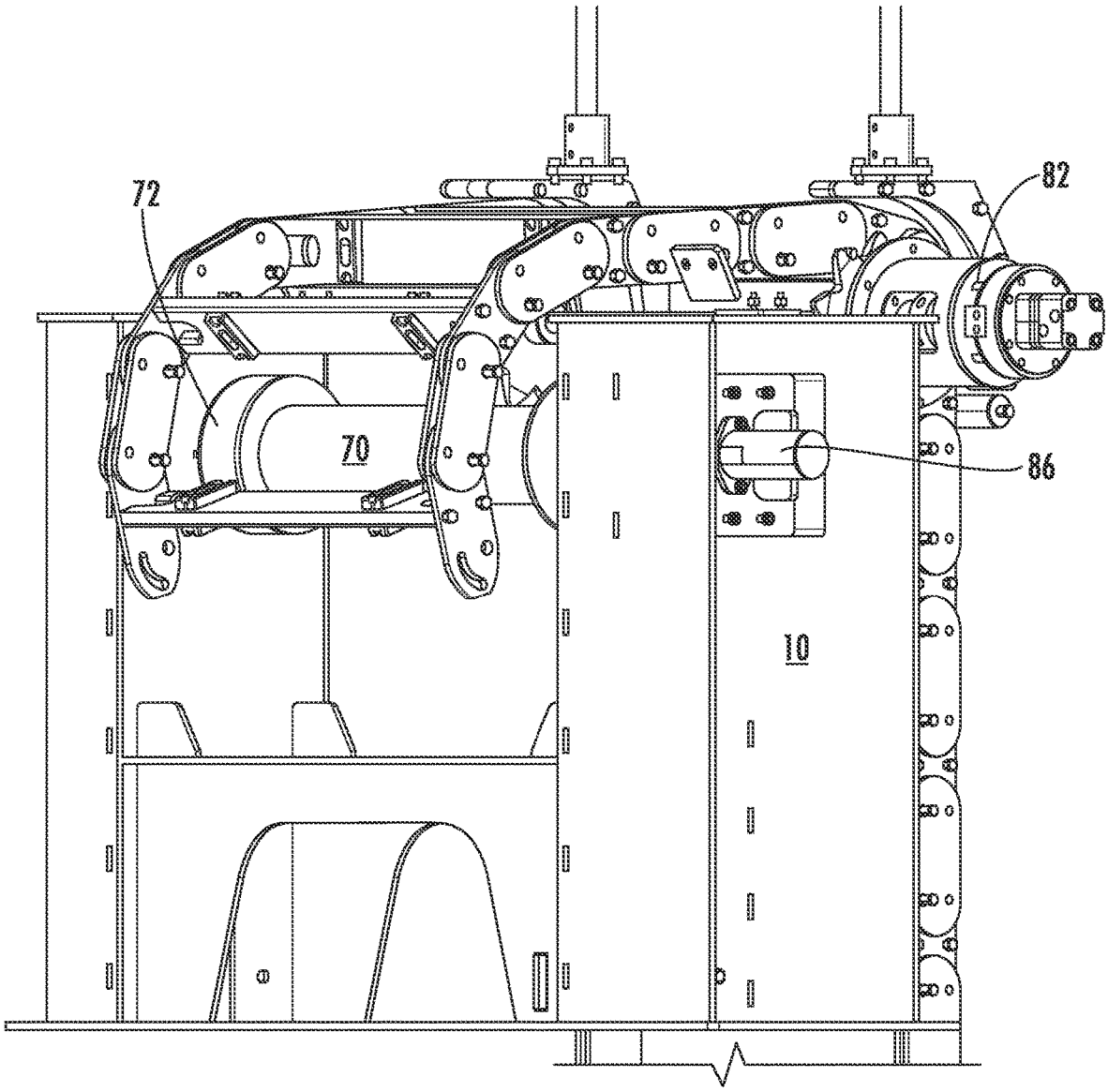
FIG. 10 illustrates a view of the reel motor mechanism of the powered retractable ladder.

Referring to FIG. 10, a view of the reel motor mechanism of the powered retractable ladder is shown.

The reel core 70 is shown, with the ladder reel bracket 72 connecting the reel core 70 to the ladder 30.

The reel core 70 is powered by the reel drive motor 86.

Figure 11:
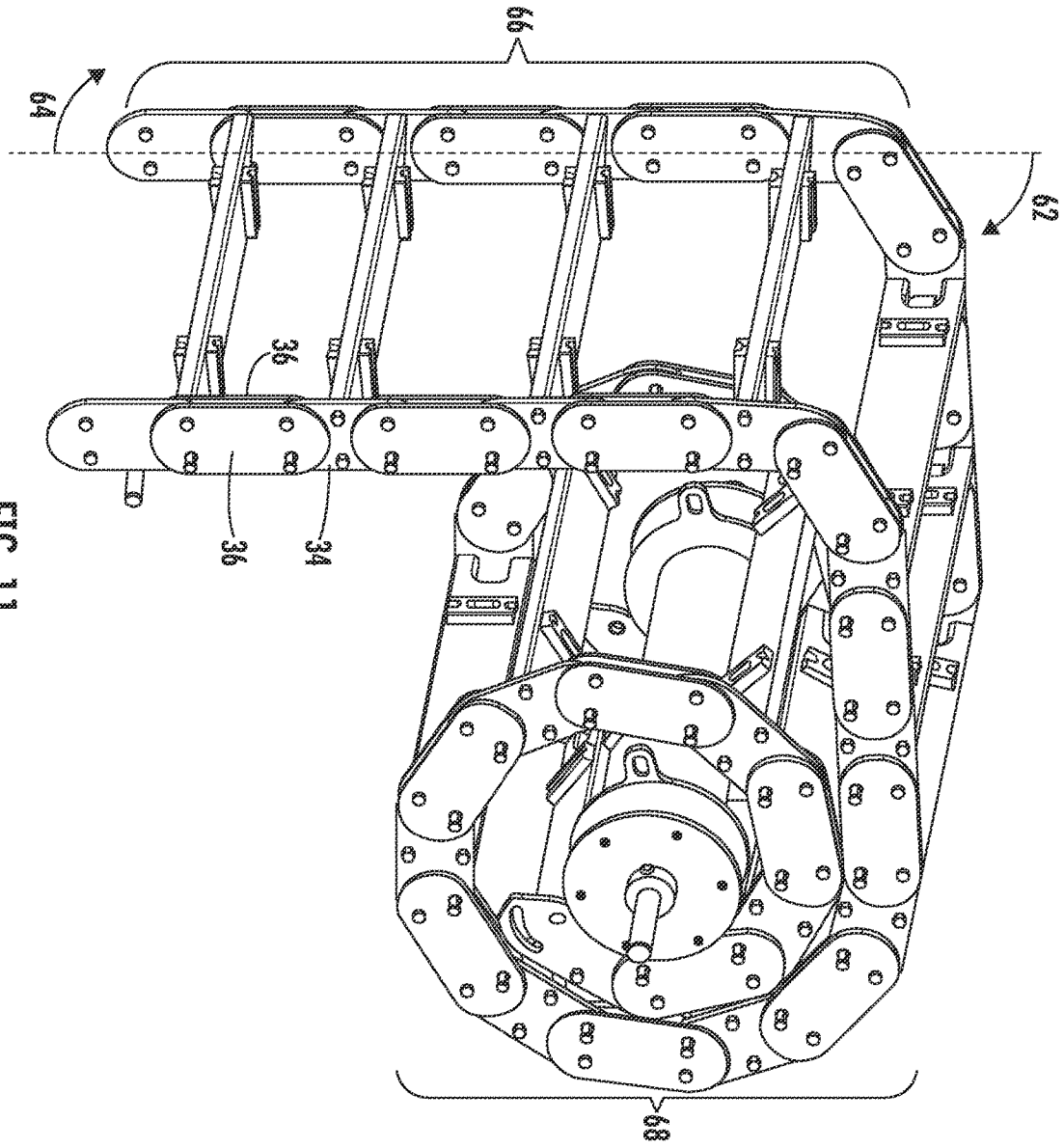
FIG. 11 illustrates a view of the retracted ladder on its reel of the powered retractable ladder.

Referring to FIG. 11, a view of the retracted ladder on its reel of the powered retractable ladder is shown.

The ladder 30 is shown in its fully wrapped position, around the reel core 70.

The ladder 30 is shown in a straight position 66 and a curved position 68. The ladder 30 can move from the straight position 66 to the curved position 68 by flexing in the direction of permitted bending 62, but not in the direction of prohibited bending 64.

Referring to FIG. 12, a detail view of the mechanisms that help to extend and guide the ladder of the powered retractable ladder is shown.

The cog drive motor 82 is shown controlling rotation of the cog drive sprocket 84, the cog drive sprocket 84 including cog drive teeth 85. The cog drive teeth 85 interact with the ladder via the hinge pins 52, the hinge pins 52 shown here as extended to protrude past the outer links 36.

The combination of the fixed ladder guides 60 and guide rollers 61 prevent outward rotation of the chain 32.

Figure 13:
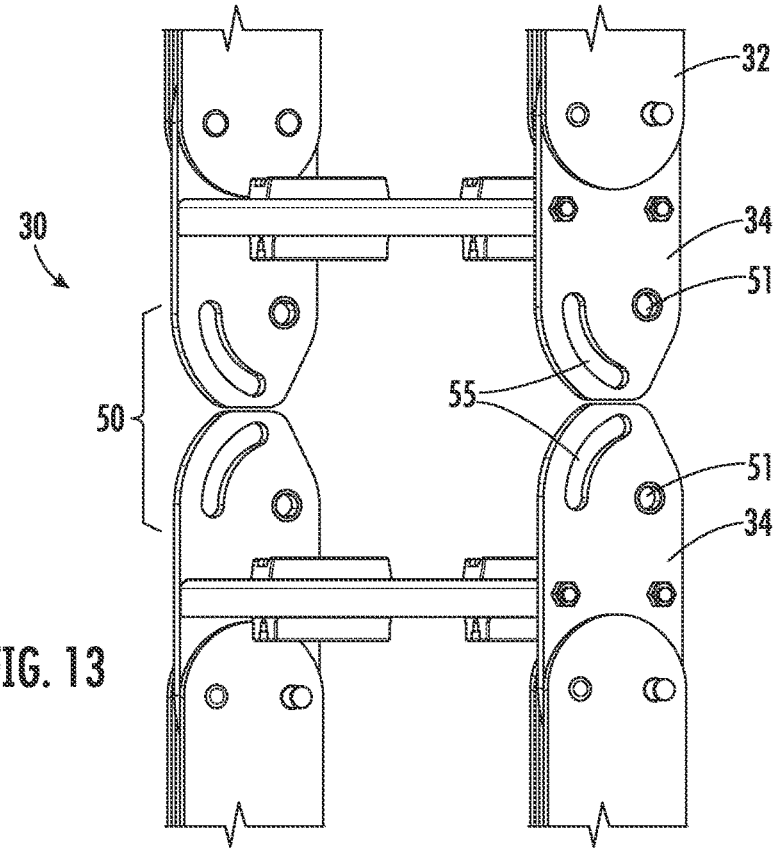
FIG. 13 illustrates a detail view of the connection between two links of the chain that forms the ladder of the powered retractable ladder.
Figure 14:
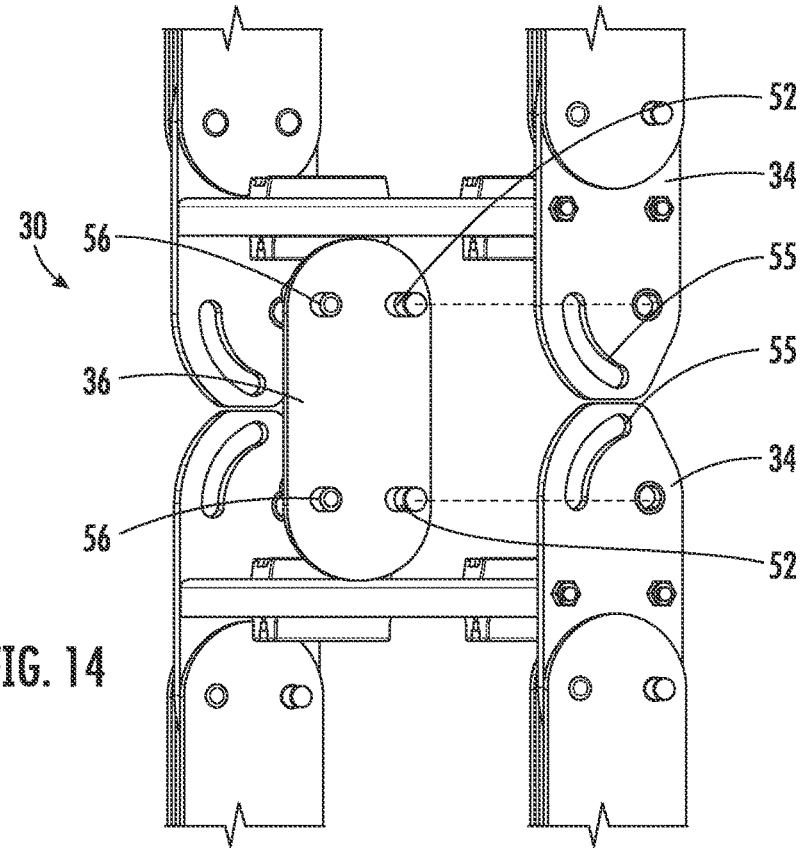
FIG. 14 illustrates a second detail view of the connection between two links of the chain that forms the ladder of the powered retractable ladder.

Referring to FIGS. 13 and 14, a detail view of the connection between two links of the chain that forms the ladder of the powered retractable ladder is shown.

The ladder 30 includes chain 32 formed from inner links 34 and outer links 36.

The inner links 34 meet at a hinge 50, including a hinge hole 51 that supports a hinge pin 52.

As the inner links 34 rotate about the hinge pin 52, the slot pin 56 slides within the slot 55.

The slot 55 is shown forming an approximately 45-degree arc. When the chain 32 is in a straight position, slot pin 56 sits within the outermost part of slot 55. As the inner links 34 rotate with respect to each other, each inner links 34 rotates approximately 45 degrees with respect to the outer link 36. The result is around 90 degrees of rotation. But the slot pins 56 within the slots 55 prevent rotation in the opposite direction, preventing the ladder from bending outward or away from the ship.

Figure 15:
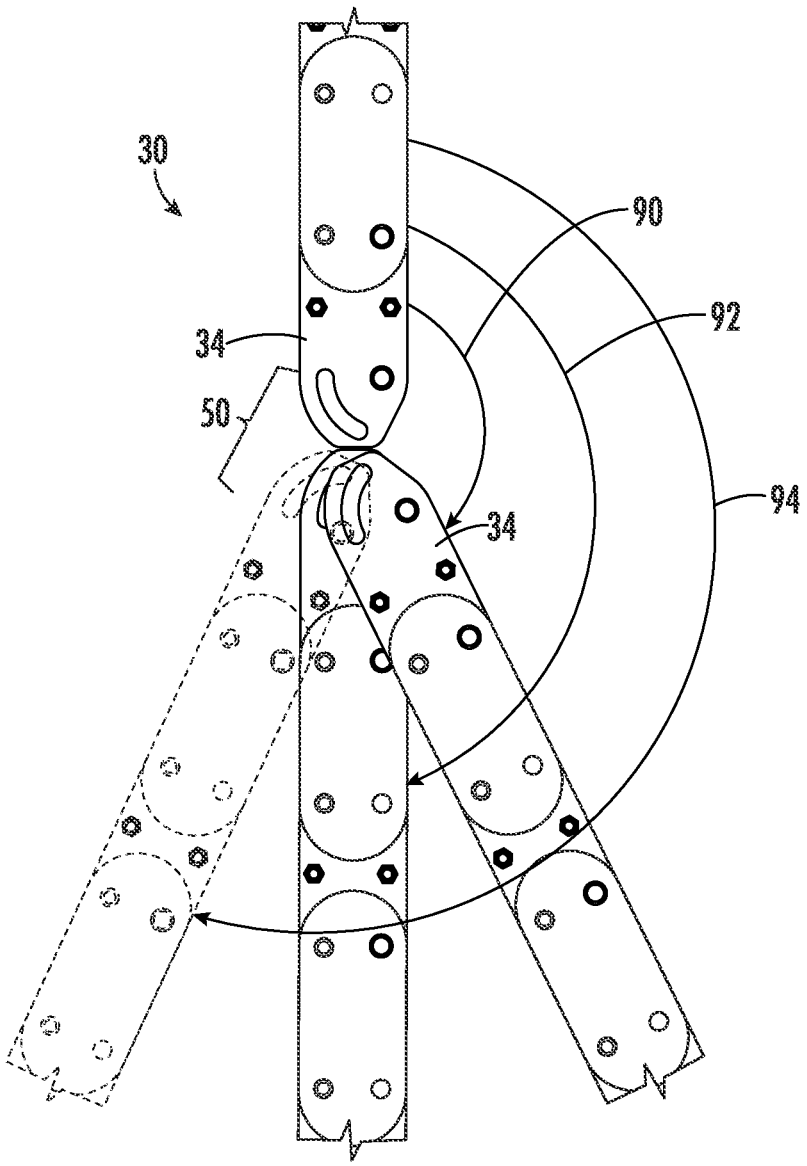
FIG. 15 illustrates a side view showing the limits of motion of the joints of the chain of the powered retractable ladder.

Referring to FIG. 15, a side view showing the limits of motion of the joints of the chain of the powered retractable ladder is shown.

The ladder 30 is shown divided into an upper and lower section, the upper and lower sections shown at differing angles with respect to each other. The hinge 50 permits the inner links 34 to bend between a straight angle 92—180 degrees—and an obtuse angle 90—less than 180 degrees. The hinge 50 does not permit rotation beyond straight, shown as a reflex angle 94—an angle in excess of 180 degrees.

In some embodiments, the hinge 50 allows rotation to angles smaller than the obtuse angle, including a right angle and an acute angle.

Equivalent elements can be substituted for the ones set forth above such that they perform in substantially the same manner in substantially the same way for achieving substantially the same result.

It is believed that the system and method as described and many of its attendant advantages will be understood by the foregoing description. It is also believed that it will be apparent that various changes may be made in the form, construction, and arrangement of the components thereof without departing from the scope and spirit of the invention or without sacrificing all of its material advantages. The form herein before described being merely exemplary and explanatory embodiment thereof. It is the intention of the following claims to encompass and include such changes.

What is claimed is:

1. A stowable ship ladder comprising:
two chains, each chain formed from a plurality of links;
the two chains bridged by a plurality of steps;
each chain of the two chains able to bend between a first position and a second position;
the first position being straight;
the second position being curved in a single direction;
each chain of the two chains only able to bend between the first position and the second position; and
a first hydraulic motor mechanically connected to a first cog gear;
the first hydraulic motor rotating the first cog gear, in turn causing upward or downward motion of the two chains, retracting or extending the two chains;
whereby when the two chains are extended along a side of a ship, the two chains can only curve toward the ship, and not away from the ship.

2. The stowable ship ladder of claim 1, further comprising:
a reel;
the two chains able to roll up around the reel by curving into the second position.

3. The stowable ship ladder of claim 1, wherein:
each pair of links of the plurality of links connects at a hinge;
each hinge allowing the plurality of links to rotate with respect to each other;
each hinge restricting rotation to a single direction away from parallel;
wherein a limited ability of the hinge to bend prevents the two chains from swinging away from the ship, which would create momentum and could injure a user.

4. The stowable ship ladder of claim 2 further comprising:
a second hydraulic motor;
the second hydraulic motor causing rotation of the reel;
the reel connected to an end of each of the two chains;
whereby rotation of the second hydraulic motor aids in extension and retraction of the two chains.

5. The stowable ship ladder of claim 4, further comprising:
a set of flexible links;
the set of flexible links in place of one or more of the plurality of links;
whereby the set of flexible links deform to avoid damage to a boat adjacent to the stowable ship ladder.

6. The stowable ship ladder of claim 2, further comprising:
a frame;
the reel rotationally connected to the frame;
a boom;
the boom rotationally connected to the frame;
the two chains passing out from the reel, along the boom, bending around a cog drive sprocket, and then passing down along the side of the ship.

7. A powered retractable ladder that is prevented from swinging away from a side of a ship, the powered retractable ladder comprising:
a ladder;
the ladder having a bent position when around a reel, and a straight position when unreeled;
the ladder unable to bend away from the side of the ship when unreeled, thus preventing a swinging motion; and
a first hydraulic motor that interfaces with the ladder;
the first hydraulic motor pulling the ladder during extension;
the first hydraulic motor pulling the ladder up during retraction;
whereby the powered retractable ladder is prevented from bending away from the ship, and thus prevented from swinging a user and causing injury.

8. The powered retractable ladder that is prevented from swinging away from a side of a ship of claim 7, wherein:
the ladder is formed from two chains, each chain formed from a plurality of links
each link of the plurality of links connects at a hinge;
each hinge allowing the plurality of links to rotate with respect to each other;
each hinge restricting rotation to a single direction away from parallel;
wherein a limited ability of the hinge to bend prevents two chains from swinging away from the ship, which would create momentum and could injure a user.

9. The powered retractable ladder that is prevented from swinging away from a side of a ship of claim 7, further comprising:
a second hydraulic motor that interfaces with the reel;
the second hydraulic motor resisting release of the ladder from the reel during extension;
the second hydraulic motor helping to raise the ladder during retraction;
whereby the second hydraulic motor cooperates with the first hydraulic motor to aid in extension and retraction of the ladder.

10. The powered retractable ladder that is prevented from swinging away from a side of a ship of claim 7, further comprising:
a set of flexible links;
the set of flexible links at an end of the ladder;
whereby the set of flexible links deform to avoid damage to a boat adjacent to the powered retractable ladder.

11. The powered retractable ladder that is prevented from swinging away from a side of a ship of claim 8, further comprising:

a frame;

the reel rotationally connected to the frame;

a boom;

the boom rotationally connected to the frame;

the two chains passing out from the reel, along the boom, bending around a cog drive sprocket, and then passing down along the side of the ship.

12. A retractable ladder for use on a ship, the retractable ladder comprising:

a plurality of links forming a chain;

each link having a range of motion with respect to its an adjacent link;

the range of motion limited to angles between a parallel position and bent in one direction;

the range of motion ranging from an acute angle to a straight angle, excluding reflex angles; and a first hydraulic motor that interfaces with the chain;

the first hydraulic motor pulling the chain during extension;

the first hydraulic motor pulling the chain up during retraction;

whereby the retractable ladder can bend only in a direction required to be rolled onto a reel and cannot be bent beyond straight.

13. The retractable ladder for use on a ship of claim 12, further comprising:

a frame;

the reel rotationally connected to the frame;

a boom;

the boom rotationally connected to the frame;

the chain passes out from the reel, along the boom, bending around a cog drive sprocket, and then passing down along a side of the ship.

14. The retractable ladder for use on a ship of claim 12, further comprising:

a second hydraulic motor that interfaces with a reel;

the second hydraulic motor resisting release of the chain from the reel during extension;

the second hydraulic motor helping to raise the chain during retraction;

whereby the second hydraulic motor cooperates with the first hydraulic motor to aid in extension and retraction of the chain.

15. The retractable ladder for use on a ship of claim 12, further comprising:

a set of flexible links;

the set of flexible links at an end of the chain;

whereby the set of flexible links deform to avoid damage to a boat adjacent to the chain.

* * * * *